US011359885B2

(12) United States Patent
Jones

(10) Patent No.: US 11,359,885 B2
(45) **Date of Patent: *Jun. 14, 2022**

(54) ARCHERY COMPOUND BOW CAM COVER AND SLING DEVICE, AND RELATED SYSTEMS AND METHODS

(71) Applicant: Alpine Innovations LLC, Lehi, UT (US)

(72) Inventor: Darren Jones, American Fork, UT (US)

(73) Assignee: Alpine Innovations LLC, Lehi, UT (US)

( * ) Notice: Subject to any disclaimer, the term of this patent is extended or adjusted under 35 U.S.C. 154(b) by 1247 days.

This patent is subject to a terminal disclaimer.

(21) Appl. No.: 15/097,089

(22) Filed: Apr. 12, 2016

(65) Prior Publication Data

US 2021/0310763 A1 Oct. 7, 2021

Related U.S. Application Data

(63) Continuation of application No. 14/514,094, filed on Oct. 14, 2014, now Pat. No. 9,310,158, which is a (Continued)

(51) Int. Cl.

| | |
|---|---|
| ***F41B 5/14*** | (2006.01) |
| ***F41B 5/10*** | (2006.01) |
| ***A45F 3/14*** | (2006.01) |

(52) U.S. Cl.

CPC ..... *F41B 5/1461* (2013.01); *F41B 5/1449* (2013.01); *F41B 5/1457* (2013.01); (Continued)

(58) Field of Classification Search

CPC ..... F41B 5/1461; F41B 5/1457 (Continued)

(56) References Cited

U.S. PATENT DOCUMENTS

| | | |
|---|---|---|
| 5,239,976 A | 8/1993 | Specht |
| 5,427,453 A | 6/1995 | Cloessner |

(Continued)

OTHER PUBLICATIONS

Easton Archery; "Crossbow Slicker;" eastronarchery.com; (upon knowledge and belief before Dec. 19, 2018); 2 pages; [retrieved Jan. 4, 2019]; Retrieved from <URL: https://eastonarchery.com/product/easton-archery-crossbow-slicker/>.

*Primary Examiner* — Justin M Larson
(74) *Attorney, Agent, or Firm* — Thorpe North & Western, LLP; David W. Osborne

(57) ABSTRACT

An archery compound bow cam cover and sling device is disclosed. The cam cover and sling device can include two cam covers operable to at least partially cover cams of a compound bow. The cam cover and sling device can also include two limb tensioning members coupled to respective cam covers, operable to extend along limbs of the compound bow, and configured to couple with the compound bow at limb ends opposite the cams. The cam cover and sling device can further include a central tensioning member coupled to the two cam covers and operable to extend between the cams, wherein the central tensioning member is configured to increase tension in the limb tensioning members to secure the cam covers about the cams. In addition, the cam cover and sling device can also include a sling coupled to the two cam covers to support, and facilitate carrying, the compound bow.

27 Claims, 4 Drawing Sheets

Related U.S. Application Data continuation-in-part of application No. 14/171,704, filed on Feb. 3, 2014, now Pat. No. 9,038,878.

(60) Provisional application No. 61/759,965, filed on Feb. 1, 2013.

(52) U.S. Cl.
CPC . *A45F 3/14* (2013.01); *F41B 5/10* (2013.01); *Y10S 224/916* (2013.01)

(58) Field of Classification Search
USPC ..... 224/257, 258, 916, 609; D22/107
See application file for complete search history.

(56) References Cited

U.S. PATENT DOCUMENTS

| | | | | |
|---|---|---|---|---|
| 5,465,887 | A | 11/1995 | Hydson | |
| 5,499,752 | A | 3/1996 | Johnson | |
| 5,513,621 | A | 5/1996 | Vanskiver | |
| D387,356 | S | 12/1997 | Kelly et al. | |
| 5,730,341 | A | 3/1998 | Hester, Jr. | |
| 5,815,125 | A | 9/1998 | Kelly et al. | |
| 5,832,912 | A | 11/1998 | Olivarez | |
| D402,990 | S | 12/1998 | Kelly et al. | |
| D425,959 | S | 5/2000 | Gibbs | |
| 6,691,693 | B1 | 2/2004 | Trussell, II | |
| D510,973 | S | 10/2005 | Primos et al. | |
| D530,387 | S | 10/2006 | Kennedy | |
| D551,314 | S | 9/2007 | Primos | |
| 7,770,768 | B1 | 8/2010 | Primos | |
| D644,705 | S | 9/2011 | Bolf | |
| 9,038,878 | B2 * | 5/2015 | Jones | F41B 5/1457 224/609 |
| 9,310,158 | B2 * | 4/2016 | Jones | F41B 5/1457 |
| D754,971 | S | 5/2016 | Nguyen | |
| D758,727 | S | 6/2016 | Barnett | |
| D821,093 | S | 6/2018 | Miller | |
| 2002/0130057 | A1 | 9/2002 | Salyers | |
| 2007/0131728 | A1 | 6/2007 | Arajakis | |
| 2012/0111309 | A1 | 5/2012 | Parks | |
| 2013/0001115 | A1 | 1/2013 | Whalen et al. | |
| 2013/0105049 | A1 | 5/2013 | Ebersole et al. | |
| 2013/0126568 | A1 | 5/2013 | Arajakis | |
| 2013/0264233 | A1 | 10/2013 | Arajakis | |
| 2014/0252058 | A1 | 9/2014 | Jones | |
| 2017/0234651 | A1 | 8/2017 | Jones | |
| 2018/0125190 | A1 | 5/2018 | Jones | |
| 2021/0254924 | A1 * | 8/2021 | Busch, Jr. | F41B 5/1461 |

* cited by examiner

ARCHERY COMPOUND BOW CAM COVER AND SLING DEVICE, AND RELATED SYSTEMS AND METHODS

PRIORITY DATA

This application is a continuation of U.S. patent application Ser. No. 14/514,094, filed Oct. 14, 2014, now issued as U.S. Pat. No. 9,310,158, which is a continuation in part of U.S. patent application Ser. No. 14/171,704, filed Feb. 3, 2014, now issued as U.S. Pat. No. 9,038,878, which claims the benefit of U.S. Provisional Patent Application Ser. No. 61/759,965, filed on Feb. 1, 2013, each of which is incorporated herein by reference.

FIELD OF THE INVENTION

The present invention relates generally to carrying devices and/or protective coverings for archery bows. Accordingly, the present invention involves the mechanical arts field.

BACKGROUND OF THE INVENTION

Archery bow cases that are used for archery bows, such as compound bows, are traditionally made of bulky, heavy, semi-rigid material. The main purpose of such an archery case is to protect the bow against damage from an impact received during storage. However, such traditional archery cases can be cumbersome, particularly when a user takes the case out into the field. The weight and bulk of such cases can hinder a bow user's mobility both when the bow is inside the case and when the case is not needed and the bow is in use. Thus, while techniques currently exist to protect a bow, the present inventors have recognized a need for a bow protection device that provides adequate protection while maximizing portability and reducing the burden of a bow cover in the field.

SUMMARY OF THE INVENTION

Accordingly, the present invention provides an archery compound bow cam cover and sling device. The present invention also provides an archery compound bow cam cover, and sling system. In one aspect, for example, an archery compound bow cam cover and sling device is provided. Such a cam cover and sling device can include a first cam cover and a second cam cover. The first cam cover can be configured to cover at least a portion of a first cam of a compound bow, and the second cam cover can be configured to cover at least a portion of a second cam of the compound bow. The cam cover and sling device can also include a first limb tensioning member and a second limb tensioning member. The first limb tensioning member can be coupled to the first cam cover, and operable to extend along a first limb of the compound bow. The first limb tensioning member can be configured to couple with the first limb at an end of the first limb opposite the first cam. The second limb tensioning member can be coupled to the second cam cover, and operable to extend along a second limb of the compound bow. The second limb tensioning member can be configured to couple with the second limb at an end of the second limb opposite the second cam. The firearm cover can further include a central tensioning member coupled to the first cam cover and the second cam cover, and operable to extend between the first cam and the second cam. The central tensioning member can be configured to increase tension in the first and second limb tensioning members to secure the first and second cam covers about the first and second cams, respectively. Additionally, the firearm cover can include a sling coupled to the first cam cover and the second cam cover to support, and facilitate carrying, the compound bow.

In another aspect, the present invention provides an archery compound bow cam cover and sling device. The cam cover and sling device can include two cam covers operable to at least partially cover cams of a compound bow. The cam cover and sling device can also include two limb tensioning members coupled to respective cam covers, operable to extend along limbs of the compound bow, and configured to couple with the compound bow at limb ends opposite the cams. The cam cover and sling device can further include a central tensioning member coupled to the two cam covers and operable to extend between the cams, wherein the central tensioning member is configured to increase tension in the limb tensioning members to secure the cam covers about the cams. In addition, the cam cover and sling device can also include a sling coupled to the two cam covers to support, and facilitate carrying, the compound bow.

In yet another aspect, the present invention provides an archery compound bow cam cover, and sling system. The system can include a compound bow having limbs, and cams coupled to ends of the limbs. The system can also include a cam cover and sling device. The cam cover and sling device can include two cam covers operable to at least partially cover the cams. The cam cover and sling device can also include two limb tensioning members coupled to respective cam covers, operable to extend along the limbs, and configured to couple with the compound bow at limb ends opposite the cams. The cam cover and sling device can further include a central tensioning member coupled to the two cam covers and operable to extend between the cams, wherein the central tensioning member is configured to increase tension in the limb tensioning members to secure the cam covers about the cams. In addition, the cam cover and sling device can include a sling coupled to the two cam covers to support, and facilitate carrying, the compound bow.

In still another aspect, the present invention provides a method for facilitating protection of, and carrying, an archery compound bow. The method can include providing a compound bow cam cover, having two cam covers operable to at least partially cover cams of a compound bow, two limb tensioning members coupled to respective cam covers, operable to extend along limbs of the compound bow, and configured to couple with the compound bow at limb ends opposite the cams, a central tensioning member coupled to the two cam covers and operable to extend between the cams, wherein the central tensioning member is configured to increase tension in the limb tensioning members to secure the cam covers about the cams. Additionally, the method can include facilitating coupling of a sling to the two cam covers, wherein the sling is operable to support the compound bow.

There has thus been outlined, rather broadly, various features of the invention so that the detailed description thereof that follows may be better understood, and so that the present contribution to the art may be better appreciated. Other features of the present invention will become clearer from the following detailed description of the invention, taken with the accompanying claims, or may be learned by the practice of the invention.

DETAILED DESCRIPTION OF THE INVENTION

Definitions

Figure 1A:
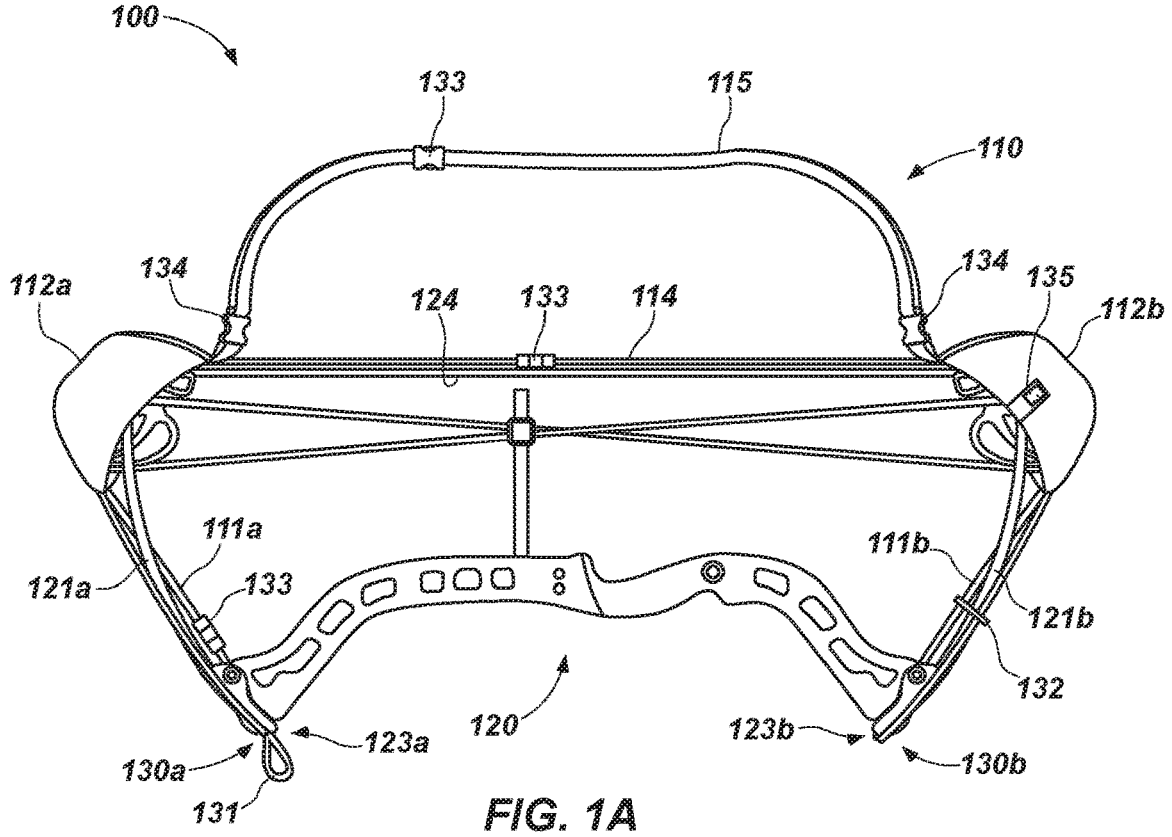
FIG. 1A is an illustration of an archery compound bow cam cover and sling device disposed about a compound bow, in accordance with an example of the present disclosure.

In describing and claiming the present invention, the following terminology will be used in accordance with the definitions set forth below.

The singular forms "a," "an," and, "the" include plural referents unless the context clearly dictates otherwise. Thus, for example, reference to "a cam cover" includes reference to one or more of such cam covers.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the composition's nature or characteristics would be permissible if present under the "consisting essentially of" language, even though not expressly recited in a list of items following such terminology. When using an open ended term, like "comprising" or "including," it is understood that direct support should be afforded also to "consisting essentially of" language as well as "consisting of" language as if stated explicitly.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein. The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "about" is used to provide flexibility to a numerical range endpoint by providing that a given value may be "a little above" or "a little below" the endpoint.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

Invention Embodiments

The present application relates to carrying devices and/or protective coverings for archery bows. In particular, embodiments of the present application include devices, systems, and methods for providing and using an archery compound bow cam cover, and sling device. Protection of archery bows, particularly compound bow cams, is conveniently and effectively provided, for example, from impact or abrasion. In some aspects, archery bows are protected from the elements of rain and snow, and from excessive dust, moisture, and debris when traveling off-road on an ATV or other vehicle. The nature of the archery compound bow cam cover, and sling device allows it to be compactable and conveniently carried and deployed when needed with a minimum of added weight or bulk.

Implementation in accordance with embodiments of the present disclosure provides protection for the archery bow while it is being carried in the field. For example, when a hunter leaves his/her house or automobile, the hunter can carry his/her bow a great distance. Quite often, the weather that the hunter encounters during a hunting trip is inclement, or, while the hunter is far from his/her house or automobile, the weather turns inclement. Embodiments of the present disclosure allow for the hunter's bow to be conveniently and effectively protected from (rather than being exposed to) the elements of rain, snow, and dust. Similarly, when traveling off-road on an ATV or other vehicle, embodiments of the present disclosure allow for the hunter's bow to be conveniently and effectively protected from (rather than being exposed to) excessive dust, moisture and debris.

While the archery compound bow cam cover, and sling device of the present disclosure has proven to be particularly useful in the area of archery bow protection, those skilled in the art can appreciate that the described devices, systems, and methods can be used in a variety of different applications and in a variety of different areas of manufacture.

Figure 1B:
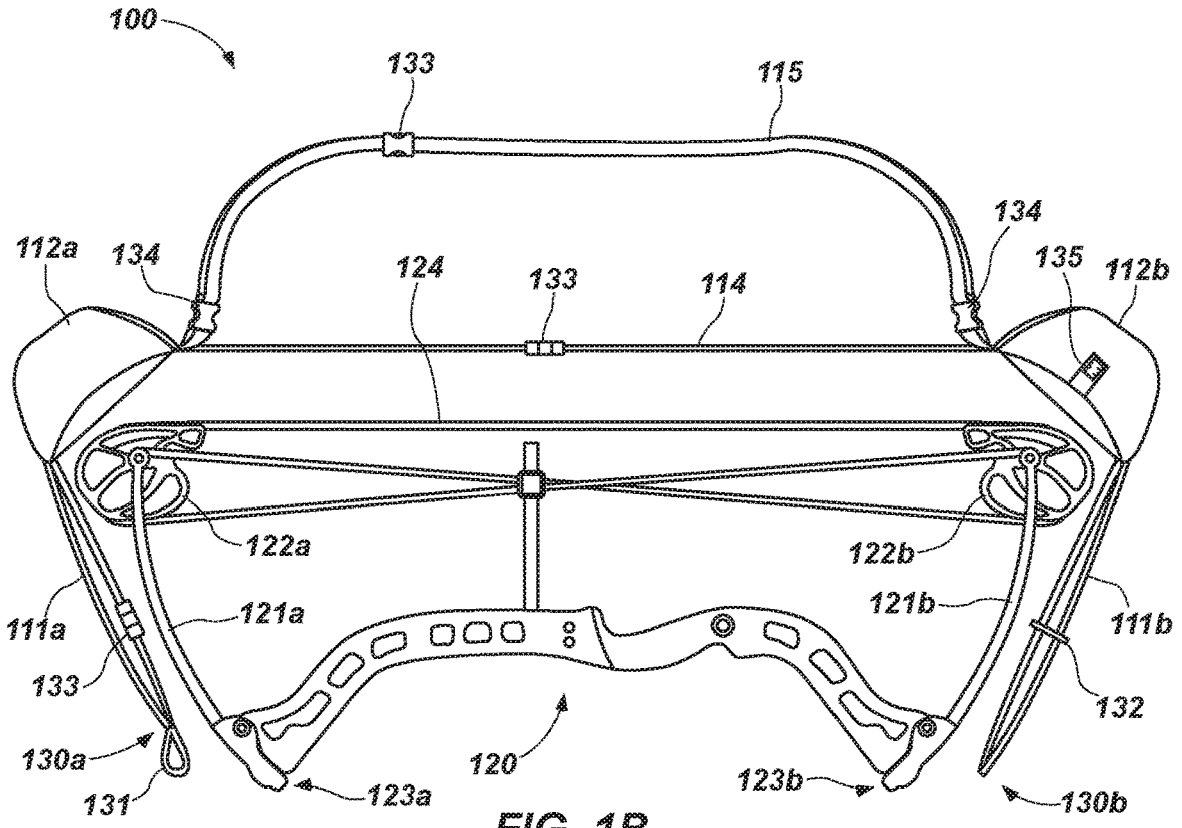
FIG. 1B is an exploded view of the archery compound bow cam cover and sling device, and compound bow of FIG. 1A.

Referring now to FIGS. 1A and 1B, a representative embodiment of an archery compound bow cam cover, and sling system 100 is shown. The system 100 generally comprises a cam cover and sling device 110 and a compound bow 120. The compound bow 120 typically includes limbs 121*a*, 121*b* and cams 122*a*, 122*b* coupled to ends 123*a*, 123*b* of the limbs, respectively. The cam cover and sling device 110 can include cam covers 112*a*, 112*b* operable to at least partially cover or encapsulate the cams to shield and protect the cams from damage. For example, cam cover 112*a* can cover cam 122*a* and cam cover 112*b* can cover cam 122*b*.

Although the cam cover 112*a*, 112*b* material can be sufficiently thick and/or have sufficient strength to protect the cams 122*a*, 122*b* against brush, branches, or other potential objects that can scratch or abrade the cams, the material can also be flexible. In one aspect, the cams can include an abrasion resistant material, a padding material, an elastic material, or any other suitable material for a cam cover, alone or in any combination. In another aspect, the cam covers can utilize a wind and/or water-repellent material. For example, materials such as Gore-Tex® fabric, or vinyl or sturdy canvas treated with a water repellant finish can be used. Other polymeric and fabric materials may be used as well. In certain aspects, the cam cover material is impermeable and/or repellant to dust, dirt, water, etc. The material can also include solids and/or various types of patterns, prints and colors to accommodate a use of the cam cover. For example, in one embodiment, a camouflage print material is used. In another embodiment, a bright, hazard or warning color fabric is used, such as safety or hunter orange. In some embodiments an interior surface of a cam cover can further comprise a non-abrasive coating or liner (not shown) to further protect the cam, such as from abrasive interaction and/or damage. In some embodiments, a non-abrasive liner comprises a woven, natural fiber-based material. In other embodiments, a liner comprises a woven, synthetic-fiber material, such as fleece. Still further, in some embodiments a liner comprises a non-abrasive flocking material. One having skill in the art will appreciate that a liner may include any material selected to protect a cam from abrasive interaction with a cam cover. As discussed in more detail hereinafter, one or both of the cam covers can include a coupling feature 135 for securing the cam cover and sling device in a compact storage bundle configuration to the compound bow.

The cam cover and sling device 110 can also include limb tensioning members 111*a*, 111*b* coupled to respective cam covers 112*a*, 112*b* and configured to extend along the limbs 121*a*, 121*b* and couple with the compound bow 120 at limb ends 123*a*, 123*b* opposite the cams. For example, limb tensioning member 111*a* can extend along limb 121*a* and can couple with the bow at limb end 123*a*. Limb tensioning member 111*b* can extend along limb 121*b* and can couple with the bow at limb end 123*b*. The limb tensioning members can create a tensioning force between the limb ends and the cam covers tending to pull the cam covers toward the limb ends. As described further hereinafter, because the limb tensioning members are coupled to opposite ends of the bow, the tensioning forces acting on the cam covers can tend to counteract one another to a certain extent, thus acting to maintain the cam covers on the respective cams.

In one aspect, one or both of the limb tensioning members can include a loop 130*a*, 130*b* to facilitate coupling with the ends 123*a*, 123*b* of the limbs 121*a*, 121*b* of the compound bow 120. Although illustrated in the figures as large loops extending from the cam covers, a limb tensioning member can comprise a smaller loop extending from or coupled to a single elongate member that is coupled to a cam cover. In another aspect, one or both of the limb tensioning members can include a user interface 131, such as a tab or loop, to facilitate grasping and/or pulling by a user in order to couple the limb tensioning members with the compound bow at the limb ends. In yet another aspect, one or both of the limb tensioning members can include a limb attachment feature 132 to maintain the limb tensioning member disposed along a limb of the compound bow. For example, the limb attachment feature can be operable to maintain the coupling of the limb tensioning member to the end of the limb of the bow. The limb attachment feature can also be operable to maintain an even tension between sides of the loop 130*a*, 130*b* to prevent twisting or rotation of the cam cover, which can tend to dislodge or remove the cam cover from the cam or reduce effectiveness of the cam cover by exposing the cam. The limb attachment feature can comprise a band or strap connected to a limb tensioning member that can wrap around a limb to secure the limb tensioning member to the limb. For example, the limb attachment feature can comprise a strap having free ends that can be coupled to one another, such as with a hook and loop fastener or a snap, after wrapping around a bow limb.

The cam cover and sling device 110 can further include a central tensioning member 114 coupled to the cam covers 112*a*, 112*b* and configured to extend between the cams 122*a*, 122*b*. The central tensioning member can be configured to increase tension in the limb tensioning members 111*a*, 111*b* to secure the cam covers about the respective cams. As mentioned above, the limb tensioning members can create tensioning force acting on the cam covers that counteract one another. The limb tensioning members are linked by the central tensioning member such that the counteracting tensioning forces act through the central tensioning member. Thus, an increase in tension of one of the limb tensioning members or the central tensioning member can increase tension in the other tensioning members. Tension in one of the limb tensioning members can therefore serve to maintain not only the proximate cam cover in place over a cam, but also the other cam cover in place over the other cam. For example, tension in limb tensioning member 111*a* can serve to maintain cam cover 112*b* in place covering cam 122*b*, and vice versa. The limb tensioning members and the central tensioning member can therefore function in concert to maintain the cam covers in place over the cams. In one aspect, the central tensioning member can be configured to extend between the cam covers proximate a bow string 124 of the compound bow 120. In another aspect, the central tensioning member can include a length adjustment feature 133 and/or an elastic material to increase tension in the limb tensioning members 111*a*, 111*b*. In yet another aspect, one or both of the limb tensioning members can include a length adjustment feature 133 and/or an elastic material to increase tension in the central tensioning member. Thus, in use, the cam cover and sling device can be quickly and easily disposed about and/or removed from the bow by elongating or stretching one or both of the limb tensioning members and/or the central tensioning member.

In addition, the cam cover and sling device 110 can include a sling 115 coupled to the cam covers 112*a*, 112*b* to support, and facilitate carrying, the compound bow 120. The secure and stable coupling of the cam covers about the cams that is provided by the limb tensioning members and the central tensioning member, the cam covers can serve as anchor locations for the sling without sliding off or displacing from the cams. If more stability is needed, tension in the limb tensioning members and/or the central tensioning member can simply be increased. With sufficient tension and the stability provided by the cam covers formed over the cams, the sling can be stably coupled to the bow to support the bow under any number of static or dynamic loading conditions, such as swinging of the bow. In one aspect, the sling can include a length adjustment feature 133 to accommodate a user's individual needs. In another aspect, the sling can be removably coupled to one or both of the cam covers, such as by a removable coupling 134, which can be useful as described hereinafter.

Figure 2:
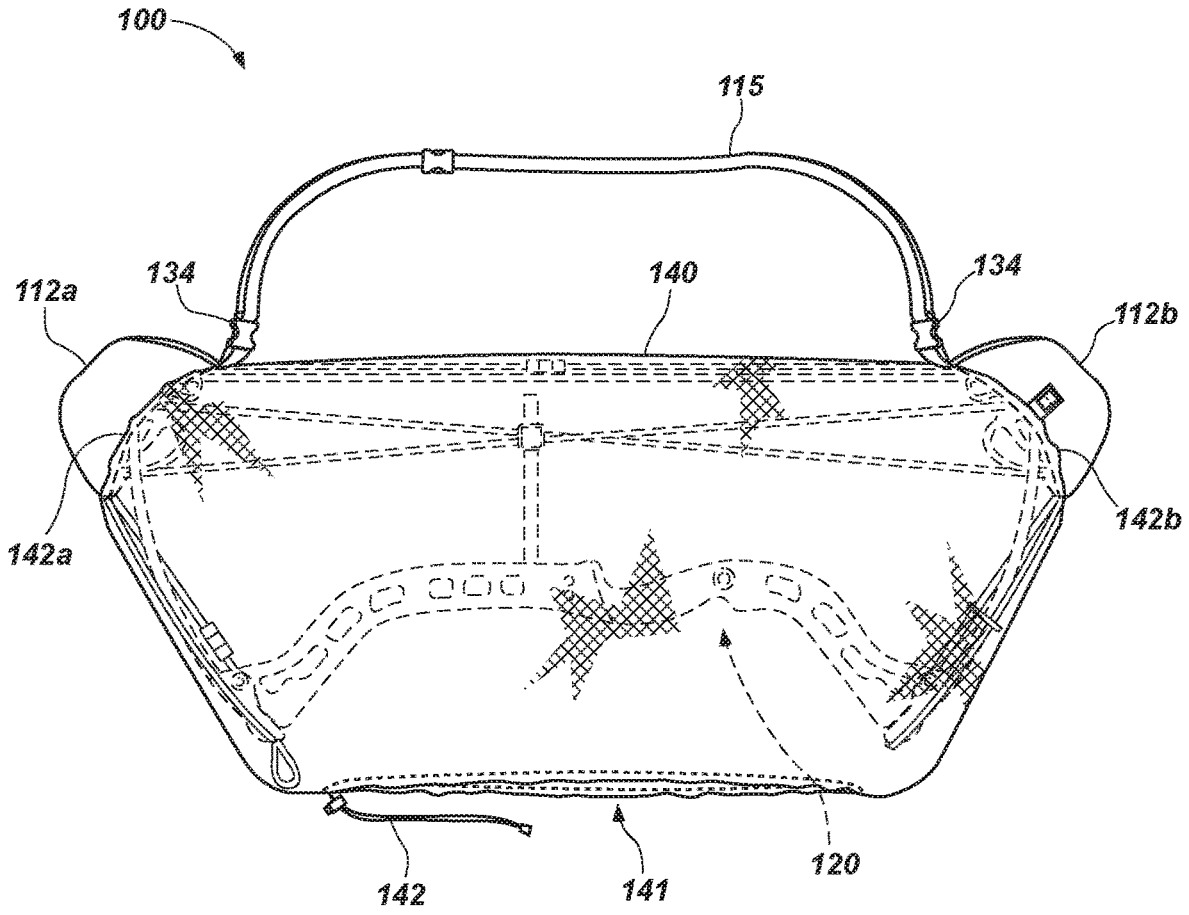
FIG. 2 is an illustration of an archery compound bow cam cover and sling device and a protective cover disposed about a compound bow, in accordance with an example of the present disclosure.

With continued reference to FIGS. 1A and 1B, and as illustrated in FIG. 2, in some embodiments the archery compound bow cam cover, and sling system 100 can include a thin, flexible protective cover 140 configured to cover at least a portion of the compound bow 120. For example, the cover can be configured as a bow cover to substantially cover the compound bow, as shown in FIG. 2. In one aspect, the cover includes a central opening 141 to receive the compound bow. In a further aspect, the central opening of the cover can be variable in size, such as with a drawstring 142 or elastic, to reduce or close the central opening such that moisture and debris are prevented from entering an interior of the cover through the central opening. Thus, the central opening can be flexible to allow expansion and contraction to allow insertion and secure covering of the cover about the bow. The cover can also include cam openings 142*a*, 142*b* corresponding to the cams 122*a*, 122*b* and cam covers 112*a*, 112*b* to facilitate extension of the cam covers at least partially through the cam openings. In one aspect, the cam openings can be variable in size, such as by an elastic or drawstring, to facilitate contact with the cam covers. Thus, the cam openings can be closed or otherwise sealed about the cam covers to create a barrier such that moisture and debris are prevented from entering an interior of the cover through the cam openings.

In one aspect, the cover 140 can include one or more openings that facilitate use of the sling 115, such as by enabling the sling to extend through the openings from the cam covers 112*a*, 112*b*. For example, the cam openings 142*a*, 142*b* can facilitate use of the sling 115 through the cam openings. One end of the sling can be temporarily decoupled from the cam cover with removable coupling 134 to allow the sling to pass through one of the cam openings of the protective cover and recoupled once the cover is in place over the bow and the cam covers. Alternately, the sling can be entirely decoupled with removable couplings 134 and removed from the cam covers while the protective cover is put in place, and then recoupled once the cover is in place.

The protective cover 140 can be made of light, flexible material and capable of being folded or rolled into a small, compact packet or configuration for compact storage of the cover when not in use. The protective cover may be fabricated from any number of thin, flexible materials, for example from a textile such as a woven nylon. In one aspect, the cover utilizes a wind and/or water-repellent material. For example, materials such as Gore-Tex® fabric, or vinyl or sturdy canvas treated with a water repellant finish can be used. Other polymeric and fabric materials may be used as well. In certain aspects, the cover material is impermeable and/or repellant to dust, dirt, water, etc. The material can also include solids and/or various types of patterns, prints and colors to accommodate a use of the cover. For example, in one embodiment, a camouflage print material is used. In another embodiment, a bright, hazard or warning color fabric is used, such as safety or hunter orange. Although the cover material is thin, lightweight, and flexible, the material can also be sufficiently thick and/or have sufficient strength to protect the bow against brush, branches or other potential objects that can scratch or abrade the bow. In some embodiments, the cover is constructed of a single piece of fabric, thereby minimizing the number of fabric panels and respective joining seams. Where joining seams are utilized, a seam tape or sealant compound can be applied to the seam to further prevent entrance of unwanted elements.

The central opening 141 of the cover 140 can be any size sufficient to allow the bow 120 to be disposed in the cover. As mentioned above, the central opening can be flexible to allow expansion and contraction to allow insertion and secure covering of the cover about the bow. Similarly, the cam openings 142*a*, 142*b* can be flexible to allow expansion and contraction to facilitate contact with the cam covers 112*a*, 112*b*. The central opening and/or the cam openings can include certain features to allow expansion and contraction of the openings. In one aspect, an opening can include a channel (not shown) for housing the drawstring such as a cinching cord or gathering cord. In some embodiments, the drawstring comprises an elastic cord, such as a shock cord. In other embodiments, the drawstring comprises a static cord, such as a string or rope. Such drawstrings can create a larger or smaller opening with a cinching mechanism to secure the drawstring. The channel can be configured to substantially rim the opening such that the opening is substantially defined by the channel. When the opening is at its largest size or greatest circumference, the drawstring can be relaxed within the channel. The opening can be closed by removing a portion of the drawstring from the channel to cinch up the drawstring, thereby reducing the size of the opening. In some embodiments, the opening comprises an elastic band entirely enclosed within the channel, such that the user is unable to access the elastic band, but rather manipulates the opening by stretching and releasing the elastic band within the channel. In some embodiments, an opening of the cover is prevented from complete closure.

In another aspect, an elastic material can be attached or sewn into the central opening 141 and/or the cam openings 142*a*, 142*b* as opposed to being disposed in the channel. In certain aspects, an opening can include other closure mechanisms, such as a zipper, hook and loop fasteners, hooks, buttons, snaps, toggle and loop, magnets, etc. Such closure mechanisms can be used alone or in any combination to open or close and/or to expand or contract the opening. In a specific aspect, such closure mechanisms can be used as secondary closure mechanisms to supplement a primary closure mechanism, such as a drawstring. For example, a drawstring can be used to create an opening of a given size and the secondary closure mechanisms, such as a toggle and loop or magnets can be used to further close the opening to provide additional coverage over the bow at the opening. The secondary closure mechanisms can be quick and easy to engage or disengage and can enhance usability of the cover by reducing use of the primary closure mechanism to size the opening once a preferred opening size has been achieved, while providing the benefit of additional coverage at the opening.

When the central opening 141 is reduced in size or contracted, the material of the cover can be gathered around the bow 120. In the process of contracting, the material of the cover can become somewhat taut around the rigid form of the bow. Accordingly, the previously loose shape of the cover can take on a general structured shape relative to the shape of the bow disposed within the cover. In this manner, cover is capable of taking on the general shape of any bow placed therein. Additionally, the cover is capable of taking on the general shape of any bow accessory or device attached to the bow, such as a quiver.

The tautness of the cover 140, following contraction of central opening 141, is beneficial in preventing pooling of water or collection of snow and dirt on the cover during transportation or storage of the bow 120. Upon contact with the cover, water, snow and dirt may simply roll or slide off of the cover material thereby maintaining the integrity and cleanliness of the cover. The tautness of the cover further reduces the exposure of excess cover fabric or material that may become snagged by branches, thorns or other natural features commonly encountered in the field. The cover can thus assist the user in preserving an undisclosed presence in the field.

In some embodiments an interior surface of the cover 140 can further comprise a non-abrasive coating or liner (not shown) to further protect the bow 120, such as from abrasive interaction and/or damage. In some embodiments, a non-abrasive liner comprises a woven, natural fiber-based material. In other embodiments, a liner comprises a woven, synthetic-fiber material, such as fleece. Still further, in some embodiments a liner comprises a non-abrasive flocking material. One having skill in the art will appreciate that a liner may include any material selected to protect the bow from abrasive interaction with the cover.

Figure 3A:
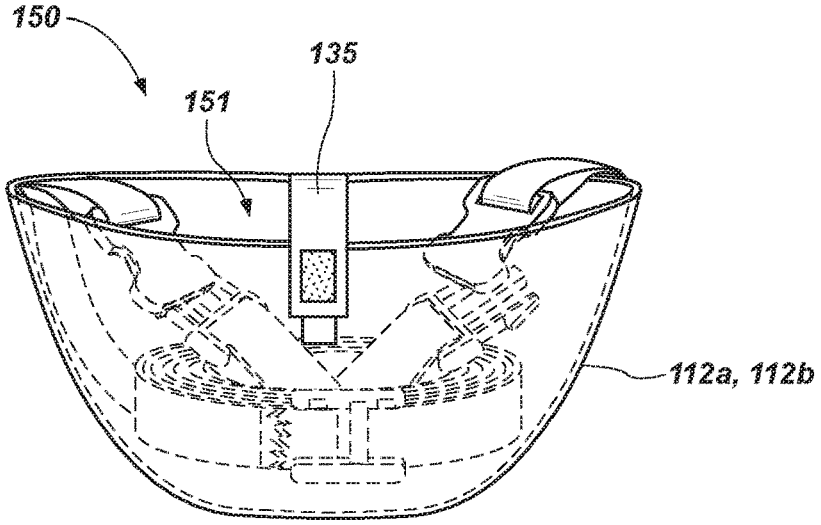
FIG. 3A is the archery compound bow cam cover and sling device of FIG. 1A shown in a compact storage configuration, in accordance with an example of the present disclosure.
Figure 3B:
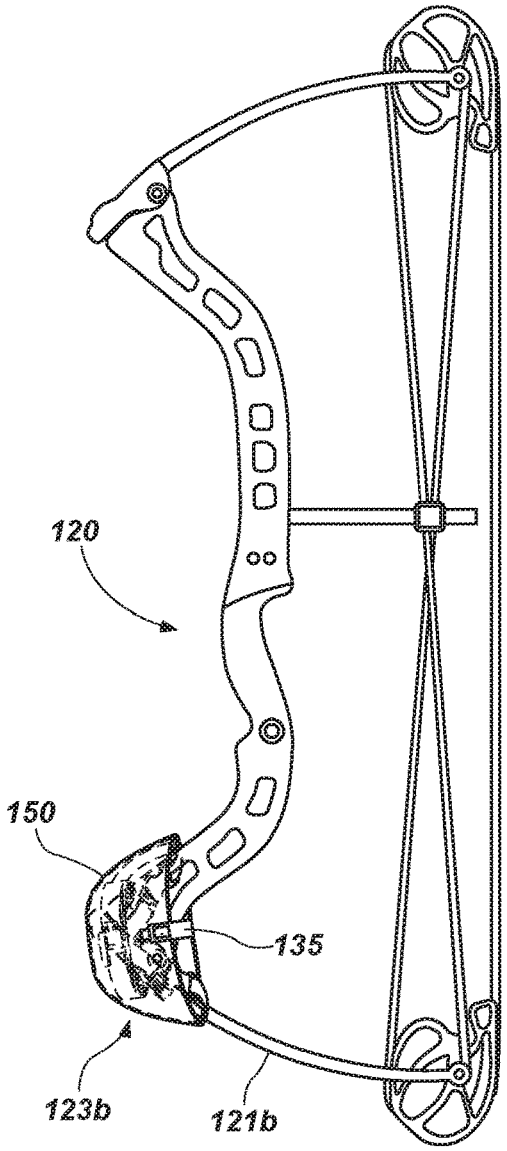
FIG. 3B is the archery compound bow cam cover and sling device in the compact storage configuration of FIG. 3A shown coupled to a compound bow, in accordance with an example of the present disclosure.

With continued reference to FIGS. 1A-2, as illustrated in FIGS. 3A and 3B one of the cam covers 121*a*, 121*b* can be operable as a storage receptacle 150 for the other cam cover, the limb tensioning members 111*a*, 111*b*, the central tensioning member 114, the sling, and/or the cover 140 to form a compact storage bundle when not in use. The coupling feature 135 can function to maintain the contents inside the cam cover as well as to secure the compact storage bundle to the compound bow 120, as shown in FIG. 3B. The other cam cover, the limb tensioning members, the central tensioning member, the sling, and/or the cover can be compacted, such as by folding, rolling, and/or stuffing, and deposited in the cam cover serving as the storage receptacle. Once placed within storage receptacle, the coupling feature 135 can be disposed about the opening 151 of the storage receptacle to retain the contents therein. In one aspect, the opening of the storage receptacle can be closed and secured with the coupling feature 135. In another aspect, the storage receptacle opening can be covered by a flap (not shown), which may or may not be secured in the same manner. Thus, the cam cover acting as a storage receptacle can provide a relatively small compact package that is easily stored about a portion of the bow 120. For example, the coupling feature 135 can attach the compact storage bundle to a desired attachment point on the bow, such as proximate the end 123*b* of the limb 121*b*. The coupling feature can include straps, snaps, hook and loop fasteners, a zipper, clips, rings, bands, hooks, loops, a carabiner, or any other suitable coupling feature for the cam cover functioning as a storage receptacle.

Figure 4:
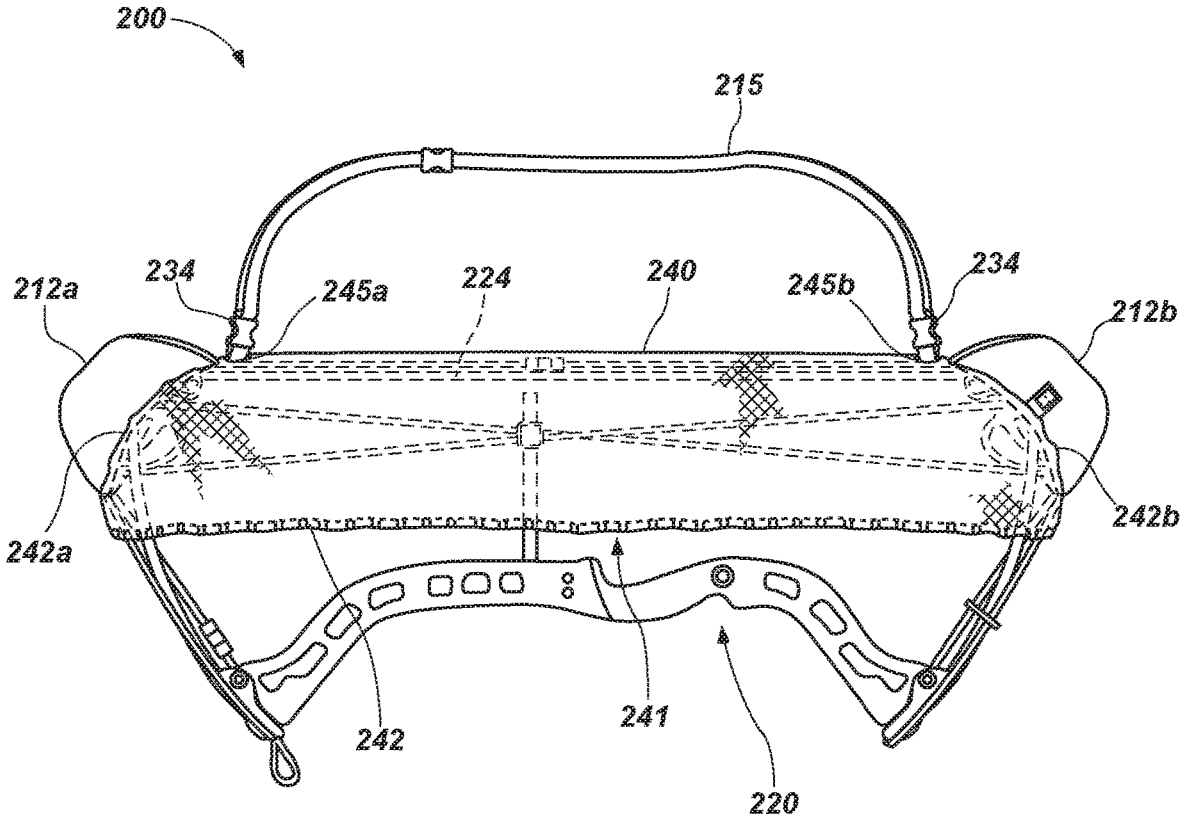
FIG. 4 is an illustration of an archery compound bow cam cover and sling device and a protective cover disposed about a portion of a compound bow, in accordance with another example of the present disclosure.

FIG. 4 illustrates an archery compound bow cam cover, and sling system 200 that includes a thin, flexible protective cover 240 in accordance with another example of the present disclosure. The cover 240 is similar in many respects to the cover 140 of FIG. 2. For example, the cover 240 is configured to cover at least a portion of a compound bow 220, and includes a central opening 241 to receive the compound bow, as well as cam openings 242*a*, 242*b* corresponding to the cams of the compound bow and cam covers 212*a*, 212*b*. In this case, the cover can be configured as a bow string cover to substantially cover a bow string 224 of the compound bow. In one aspect, the central opening of the cover can be variable in size, such as with a drawstring or elastic 242, to reduce the central opening about the compound bow and maintain the cover in position to shield or protect the string of the compound bow. Thus, the central opening can be flexible to allow expansion and contraction to allow insertion of the bow and secure covering of the cover about the string of the bow. The central opening can also include any suitable closure mechanism to prevent or minimize access of moisture and debris to the bow string, such as a zipper, hook and loop fasteners, hooks, buttons, snaps, toggle and loop, magnets, etc. The cam openings can be variable in size, such as by an elastic or drawstring, to facilitate contact with the cam covers. Thus, the cam openings can be closed or otherwise sealed about the cam covers to create a barrier such that moisture and debris are prevented from entering an interior of the bow cover through the cam openings.

In one aspect, the cover 240 can include one or more openings that facilitate use of the sling 215, such as by enabling the sling to extend through the openings from the cam covers 212*a*, 212*b*. For example, the cover can include sling openings 245*a*, 245*b* that allow the sling 215 to extend from the cam covers through the sling openings. For example, one end of the sling can be temporarily decoupled from the cam cover with removable coupling 234 to allow the sling to pass through one of the sling openings of the protective cover and recoupled once the cover is in place over the bow and the cam covers. Alternately, the sling can be entirely decoupled with removable couplings 234 and removed from the cam covers while the protective cover is put in place, and then recoupled once the cover is in place. In one aspect, the sling openings can be configured to be proximate the coupling of the sling to the cam covers.

In accordance with one embodiment of the present invention, a method for facilitating protection of, and carrying, an archery compound bow is disclosed. The method can comprise providing a compound bow cam cover, having two cam covers operable to at least partially cover cams of a compound bow, two limb tensioning members coupled to respective cam covers, operable to extend along limbs of the compound bow, and configured to couple with the compound bow at limb ends opposite the cams, a central tensioning member coupled to the two cam covers and operable to extend between the cams, wherein the central tensioning member is configured to increase tension in the limb tensioning members to secure the cam covers about the cams. Additionally, the method can comprise facilitating coupling of a sling to the two cam covers, wherein the sling is operable to support the compound bow. It is noted that no specific order is required in this method, though generally in one embodiment, these method steps can be carried out sequentially.

In one aspect, the central tensioning member can comprise at least one of a length adjustment feature and an elastic material to increase tension in the limb tensioning members. In another aspect, at least one of the limb tensioning members can comprise at least one of a length adjustment feature and an elastic material to increase tension in the central tensioning member.

Of course, it is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. An archery compound bow cam cover and sling device, comprising:

a first cam cover and a second cam cover, the first cam cover configured to cover at least a portion of a first cam of a compound bow, and the second cam cover configured to cover at least a portion of a second cam of the compound bow;

a first limb tensioning member and a second limb tensioning member, the first limb tensioning member coupled to the first cam cover, and operable to extend along a first limb of the compound bow, wherein the first limb tensioning member is configured to couple with the first limb at an end of the first limb opposite the first cam, and the second limb tensioning member coupled to the second cam cover, and operable to extend along a second limb of the compound bow, wherein the second limb tensioning member is configured to couple with the second limb at an end of the second limb opposite the second cam;

and a sling coupled to the first cam cover and the second cam cover.

2. The device of claim 1, wherein at least one of the first and second limb tensioning members comprises at least one of a length adjustment feature and an elastic material to increase tension in the central tensioning member.

3. The device of claim 1, wherein at least one of the first and second limb tensioning members comprises a loop to facilitate coupling with the ends of the limbs of the compound bow.

4. The device of claim 1, wherein at least one of the first and second limb tensioning members comprises a limb attachment feature to maintain the limb tensioning member disposed along the limb of the compound bow.

5. The device of claim 1, wherein at least one of the first and second limb tensioning members comprises a user interface to facilitate grasping by a user to couple the limb tensioning member with the compound bow at the limb ends.

6. The device of claim 1, wherein the sling comprises a length adjustment feature.

7. The device of claim 1, wherein the sling is removably coupled to at least one of the cam covers.

8. The device of claim 1, wherein one of the first and second cam covers is operable as a storage receptacle for the other of the cam covers, the limb tensioning members, the central tensioning member, and the sling to form a compact storage bundle when not in use.

9. The device of claim 8, wherein the cam cover operable as a storage receptacle comprises a coupling feature for securing the compact storage bundle to the compound bow.

10. The device of claim 1, further comprising a thin, flexible protective cover configured to cover at least a portion of the compound bow, wherein the cover includes at least one opening to facilitate use of the sling extending therethrough from the cam covers.

11. The device of claim 10, wherein the cover comprises a bow cover configured to substantially cover the compound bow.

12. The device of claim 10, wherein the cover comprises a bow string cover configured to substantially cover a bow string of the compound bow.

13. The device of claim 10, wherein the at least one opening comprises at least one sling opening configured to be proximate at least one coupling of the sling to the cam covers.

14. The device of claim 10, wherein the at least one opening comprises at least one cam opening corresponding to at least one of the cams to facilitate extension of the corresponding cam covers at least partially through the cam opening.

15. The device of claim 14, wherein the at least one cam opening is variable in size to facilitate contact with the corresponding cam cover.

16. The device of claim 10, wherein the cover includes a central opening to receive the compound bow.

17. The device of claim 16, wherein the central opening of the cover is variable in size.

18. The device of claim 10, wherein one of the first and second cam covers is operable as a storage receptacle for the other of the cam covers, the limb tensioning members, the central tensioning member, the sling, and the cover to form a compact storage bundle when not in use.

19. The device of claim 18, wherein the cam cover operable as a storage receptacle comprises a coupling feature for securing the compact storage bundle to the compound bow.

20. The device of claim 1, further comprising:

a central tensioning member coupled to the first cam cover and the second cam cover, and operable to extend between the first cam and the second cam, wherein the central tensioning member is configured to increase tension in the first and second limb tensioning members to secure the first and second cam covers about the first and second cams, respectively.

21. The device of claim 20, wherein the central tensioning member is configured to extend between the first cam cover and the second cam cover proximate a bow string of the compound bow.

22. The device of claim 20, wherein the central tensioning member comprises at least one of a length adjustment feature and an elastic material to increase tension in the limb tensioning members.

23. A method for facilitating protection of, and carrying, an archery compound bow, comprising:

providing a compound bow cam cover and sling device as recited in claim 1; and facilitating coupling of a sling to the two cam covers, wherein the sling is operable to support the compound bow.

24. An archery compound bow cam cover, and sling system, comprising:

a compound bow having limbs, and cams coupled to ends of the limbs; and a cam cover and sling device, having two cam covers operable to at least partially cover the cams, two limb tensioning members coupled to respective cam covers, operable to extend along the limbs, and configured to couple with the compound bow at limb ends opposite the cams, and a sling coupled to the two cam covers to support, and facilitate carrying, the compound bow.

25. The device of claim 24, further comprising a thin, flexible protective bow cover substantially covering at least a portion of the compound bow, wherein the bow cover includes cam opening to facilitate use of the sling extending therethrough from the cam covers.

26. The device of claim 25, wherein the cover includes a central opening to receive the compound bow.

27. An archery compound bow cam cover and sling device, comprising:

two cam covers operable to at least partially cover cams of a compound bow;

two limb tensioning members coupled to respective cam covers, operable to extend along limbs of the compound bow, and configured to couple with the compound bow at limb ends opposite the cams;

and a sling coupled to the two cam covers.

* * * * *